United States Patent [19]

Neki et al.

[11] Patent Number: 4,732,099

[45] Date of Patent: Mar. 22, 1988

[54] MOTOR CONTROLLER FOR A SEWING MACHINE

[75] Inventors: Shigeo Neki, Osaka; Kenichi Ohara, Hirakata; Nobuho Shibata, Katano; Takashi Dohi, Hirakata, all of Japan

[73] Assignee: Matsushita Electric Industrial Co., Ltd., Kadoma, Japan

[21] Appl. No.: 926,532

[22] Filed: Nov. 4, 1986

[30] Foreign Application Priority Data

Nov. 6, 1985 [JP] Japan ..... 60-248215

[51] Int. Cl.[4] ..... D05B 69/26

[52] U.S. Cl. ..... 112/275; 318/369

[58] Field of Search ..... 112/275, 277, 67, 87; 318/369, 269, 270, 371, 375

[56] References Cited

U.S. PATENT DOCUMENTS 3,851,237 11/1974 Yokoyama et al. ..... 112/275 X
4,403,563 9/1983 Shinozaki et al. ..... 112/275
4,516,514 5/1985 Neki et al. ..... 112/275

*Primary Examiner*—Peter Nerbun
*Attorney, Agent, or Firm*—Cushman, Darby & Cushman

[57] ABSTRACT

A motor controller for a sewing machine starts to count the number of pulse signals issued during rotation of a motor after reception of a stop signal and the detection of the needle position, and thereby sets a speed value for controlling the rotation speed of the motor so that it gradually slows based on the result of the counting of the pulse signals and so that the rotation speed of the motor goes to zero when it reaches a predetermined low value.

6 Claims, 5 Drawing Figures

MOTOR CONTROLLER FOR A SEWING MACHINE

FIELD OF THE INVENTION AND RELATED ART STATEMENT

1. Field of the Invention

The present invention relates to a motor controller of a sewing machine for starting or stopping a motor of the sewing machine in response to a starting or stopping signal from a foot switch or a manual switch, and especially a motor controller of a sewing machine which has a function of stopping the needle at a predetermined position.

2. Description of the Related Art

Needle moving speed, which is controlled by a conventional motor controller of a sewing machine, is shown in FIG. 1 with respect to time, and it is described as follows with reference to FIG. 1.

Generally, a magnetic clutch type motor is used as a motor of a sewing machine, the motor having cluth-and-brake coils, linings of respective clutches and a magnetic circuit thereof. The needle positioning method for stopping the needle at a predetermined position is practiced with such a motor as follows. At first, when a stop signal is issued during normal maximum speed operation "N max", the needle speed (sewing speed) is quickly decreased by a brake signal "Br" and shifted to slow speed operation "Nlow" at point "$\alpha$". Next, at point "$\beta$", where a predetermined needle position signal "Nd" is issued, the brake coil is maximally excited, and the needle (sewing machine) stops at point "$\gamma$", which is the position where the needle is to be stopped. Furthermore, after a time period $T_1$, which is longer by a certain margin than a time required to stop the sewing machine from the point of time "$\beta$", the needle is stopped at the predetermined position.

In the above-mentioned conventional needle positioning method, the needle stopping control after the point "$\beta$", where the needle position signal "Nd" is issued, is an open control, and the brake coil is maximally excited unconditionally for a fixed time period. Accordingly, in such a method the needle is not positioned precisely. That is, error in the needle stop position is caused by (1) change of the needle speed at point "$\beta$", (2) change of inertia or load of the sewing machine, (3) change of brake power corresponding to the potential change of the electric power source, (4) change of coefficient of friction on a surface of the brake lining caused by friction heating and the like. Due to such errors the conventional motor controller of a sewing machine is inaccurate, and because improvement in the precision of stopping position is limited, a discrepancy in the stopping position after cutting thread occurs, or in a worse case, the breaking in two of the needle occurs due to interference of the needle and the thread wiper.

OBJECT AND SUMMARY OF THE INVENTION

The object of the present invention is to provide an improved motor controller for a sewing machine by which a needle of the sewing machine may be precisely stopped at a predetermined position.

A motor controller of such a sewing machine in accordance with the present invention comprises:

pulse generating means for generating plural pulse signals for each rotation of a motor shaft, speed measuring means for measuring rotational speed of the motor shaft and for generating a signal representative of a measured rotational speed of the motor shaft, needle position detecting means for detecting the position of a needle and for generating a needle position signal, motion command means for commanding the start or stop of rotation of the motor shaft, speed setting means for setting rotation speed of the motor shaft and for generating a signal of a lower set speed when a stop signal is generated by the motion command means, speed control means for controlling rotation speed of the motor shaft, needle position confirming means for confirming the position of the needle and for generating a position control command signal when the signal repesentative of a measured rotational speed reaches the lower set speed and the needle position signal is detected, counter means for counting the number of pulse signals by receiving the position control command signal and for generating a first speed set signal which is reduced to zero when the counted number of pulse signals reaches a predetermined value, converter means for converting an output of the counter means into a second speed set signal, and switching means for disabling the first speed set signal from the speed setting means and for enabling the second speed set signal from the converter means, with reference to the position control command signal.

DESCRIPTION OF THE PREFERRED EMBODIMENT

A preferred embodiment for a motor controller of sewing machine in accordance with the present invention is described as follows with reference to FIG. 2, FIG. 3, FIG. 4 and FIG. 5.

Figure 1:
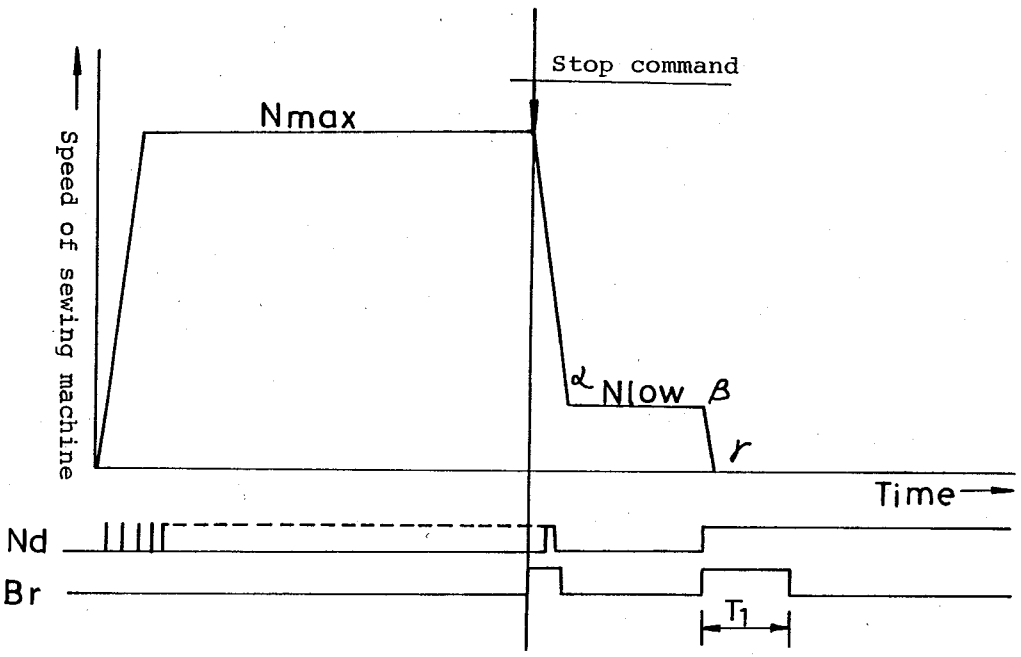
FIG.1 (Prior Art)
FIG. 1 is a timing chart showing the operation of the conventional motor controller of a sewing machine.
Figure 2:
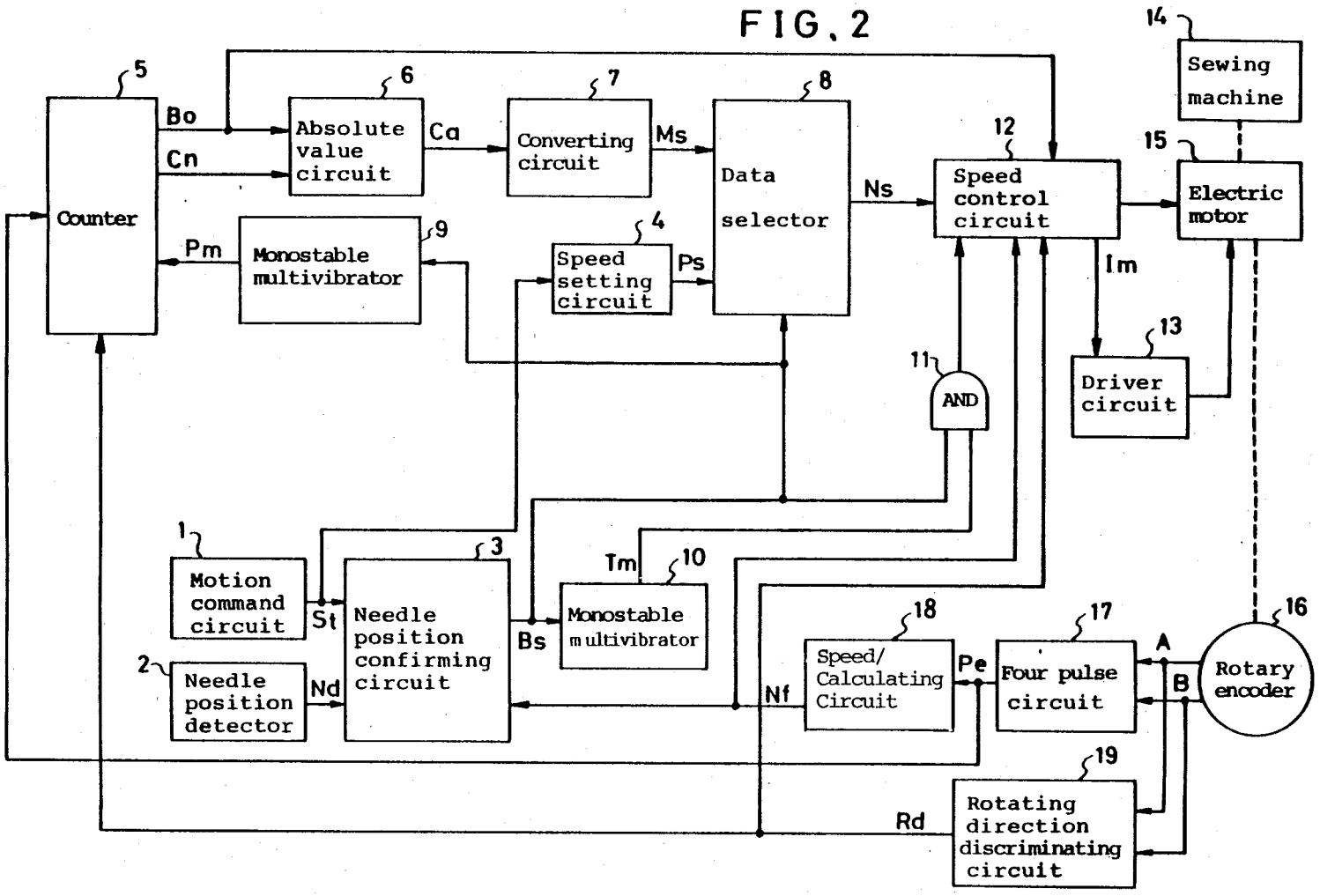
FIG. 2 is a block diagram showing an embodiment of a motor controller of a sewing machine in accordance with the present invention.

FIG. 2 is a block diagram showing an embodiment of a motor controller for a sewing machine in accordance with the present invention. In FIG. 2, a motion command circuit 1 issues a start or stop signal "St" to a motor in response to the switching on/off of a switch or the pushing down or release of a pedal of a foot switch. A needle position detecting device 2 constituted by a Hall device is used to detect the rotation of a rotating magnet or to detect the reflecting light from a rotating mirror using a photo-sensor, and needle position detecting device 2 issues a needle position signal "Nd" at the top position or the bottom position of the needle movement. A needle position confirming circuit 3 constituted by a logic circuit is responsive to start or stop signal "St" and needle position signal "Nd" and outputs an output signal "Bs". A speed setting device 4 responsive to start or stop signal "St" issues a speed signal "Ps" which corresponds to the position of the pedal stepped on or a value set by a volume controller.

The present embodiment also includes a counter circuit 5 and an absolute value circuit 6 which are respectively constituted by logic circuits. The output "Ca" of absolute value circuit 6 is received by a converter circuit 7 constituted by a multiplying circuit. A data selector 8, monostable multivibrators 9 and 10 and an AND gate 11 are arranged as shown and respectively constituted by discrete ICs (integrated circuits). a speed control circuit 12 responsive to a set speed signal "Ns" outputted by data selector 8 is constituted by a digital circuit or an analogue circuit. A driver 13 for driving a motor 15 is combined directly or with a belt inbetween with a sewing machine 14, and the driver 13 is constituted by power transistors and an electric power source circuit for driving them.

The present embodiment further includes a rotary encoder 16 for detecting the position of a rotating multiple magnet using a magnetic sensor such as a magnetic resistance device or for detecting the position of a rotating disc with slits by using a transmitting type photosensor. Rotary encoder 16 also issues two pulse signals "A" and "B", whose phases are respectively shifted electrically by 90 degrees, by using two of the above-mentioned sensors. A four-pulse circuit 17 responsive to pulse signals "A" and "B" is constituted by a discrete IC so as to generate pulse signals "Pe" at front and rear edges of the pulse signals "A" and "B". A speed calculating circuit 18 then issues a real speed signal "Nf" which shows the real speed of the motor using a built-in timer and an operating circuit with reference to the pulse signal "Pe" of the four-pulse circuit 17. A rotation direction discriminating circuit 19 constituted by a logic circuit is also responsive to pulse signals "A" and "B" and has a function of detecting the rotation direction of the motor by detecting the order of phase delay between the pulse signals "A" and "B" and of generating a rotation direction indicating signal "Rd".

Operation of the above-mentioned motor controller for a sewing machine will be described in the following:

At first, when the output signal "St" of the motion command circuit 1 represents the starting command, the speed setting device 4 issues the speed signal "Ps" responding to the position of the pedal, the needle position confirming circuit 3 changes its output "Bs" to "L" level from "H" level, and the data selector 8 is switched to select the speed "Ps" and to issue a set speed "Ns". The speed control circuit 12 controls the motor 15 via driver 13 so as to minimize the deviation between the set speed "Ns" and the real speed "Nf". Accordingly, the motor 15 rotates in a speed corresponding to the set speed "Ns".

Next, stopping operation of the sewing machine from the above-mentioned normal operation corresponding to the position of the pedal is described below. At first, when the output signal "St" representing the stopping command of the motion command circuit 1 is issued, the speed setting device 4 issues the signal "Ps" of a slow speed for positioning, and the speed control circuit 12 quickly brakes the motor 15 because the deviation between the set speed "Ns" corresponding to the lower speed and the real speed "Nf" becomes large. Next, the needle position confirming circuit 3 changes its output signal "Bs" from "L" level to "H" level when the real speed signal "Nf" reaches the slow speed corresponding to the speed signal "Ps" and the front edge of the needle position signal "Nd" is detected. Thereafter, the operations of the motor controller of the sewing machine shifts to the needle position detecting mode.

Figure 3:
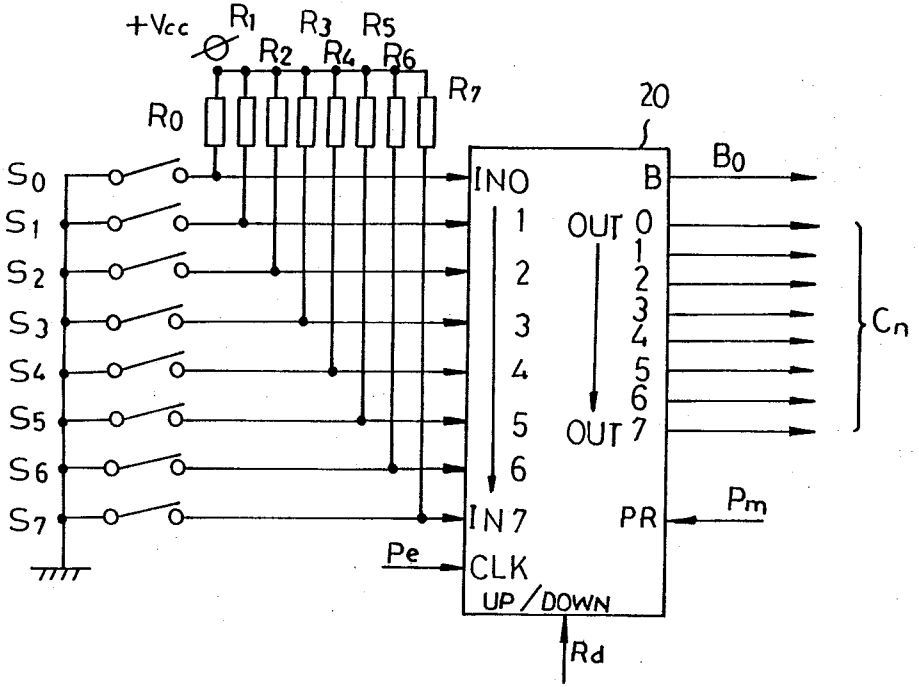
FIG. 3 is a circuit diagram showing an embodiment of a counter circuit in accordance with the present invention.

Hereupon, FIG. 3 shows a concrete constitution of the counter circuit 5. In FIG. 3, the counter circuit 5 is constituted by resistor $R_0$ to $R_7$, switches $S_0$ to $S_7$ and an up/down counter 20 which can preset 8 bit data.

As mentioned above, when the signal "Bs" changes from "L" level to "H" level, the monostable multivibrator 9 issues pulse signal "Pm", and the counter 20 presets the data which is set by the switches $S_0$ to $S_7$ and starts to count the orderly fourfold pulse signals "Pe". At this time, the rotation direction discriminating signal "Rd" shows the positive rotation. Accordingly, at first, the counter 20 counts down. The absolute value circuit 6 then calculates the absolute value from a counted value "Cn" of the counter 20 and a column borrowing signal "Bo", which shows that the count down result is negative, and outputs the absolute value data "Ca". The converter circuit 7 then converts the absolute value data "Ca" into a value of a set speed "Ms" by multiplying "Ca" by a predetermined value and issuing the value. On the other hand, the shifting of the signal "Bs" to "H" level is caused by changing the data selector 8 for selecting the value of set speed "Ms", and the speed control circuit 12 thus controls the speed of the motor 15 in response to the value of set speed "Ms".

Figure 4:
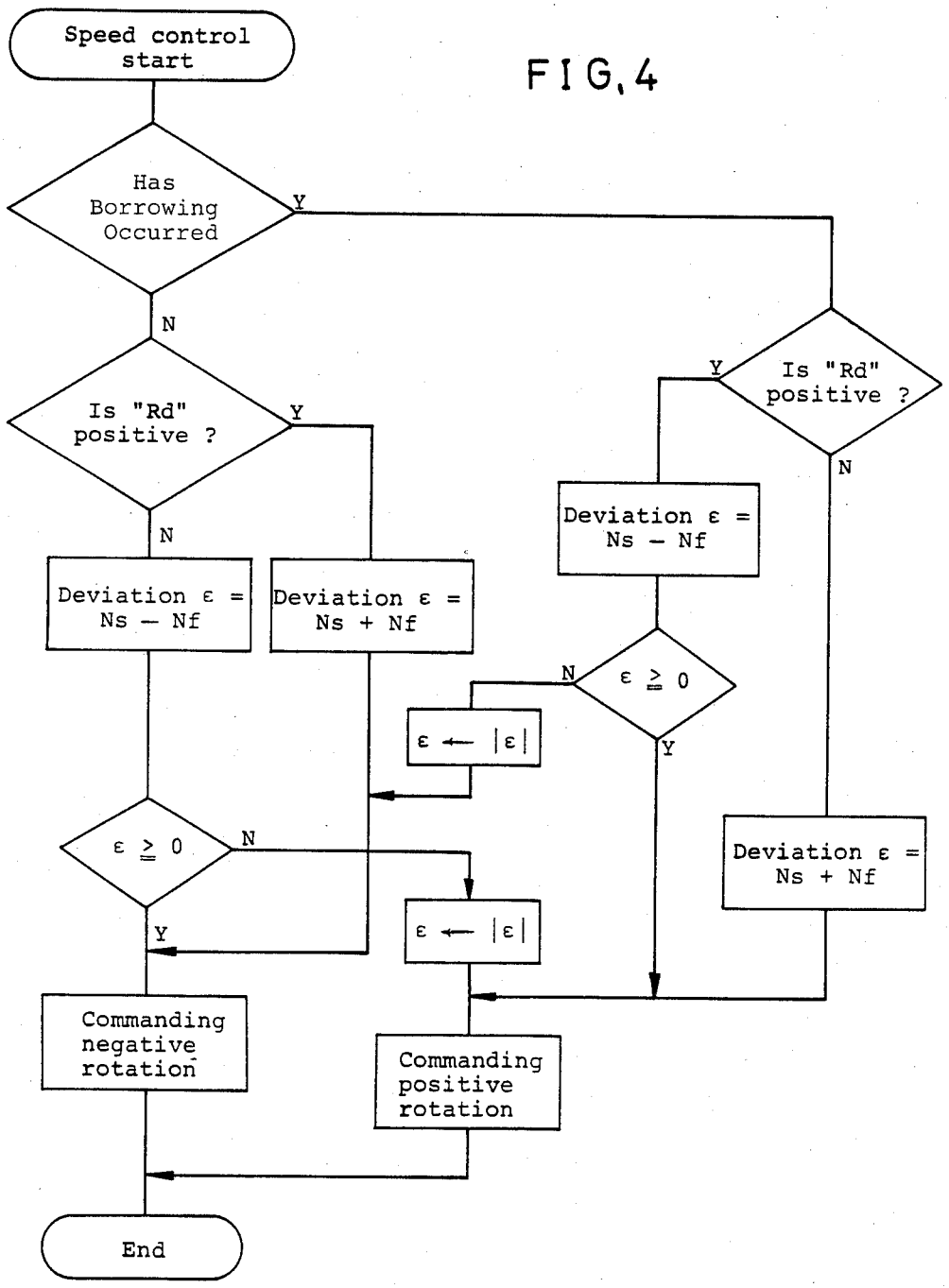
FIG. 4 is a flow chart showing the manner of speed control of a motor controller of sewing machine in accordance with the present invention.

Hereupon, the speed control circuit 12 can be constituted by a microcomputer, and FIG. 4 shows a flow chart of a speed control method in such a case.

When a borrowing signal "Bo" is issued, it shows that the number of predetermined pulses has been already counted and the needle has passed through the target stopping position. The motor needs to rotate at the set speed "Ns" in the reverse direction, but the deviation of speed "$\epsilon$" is calculated in two ways depending on the real indication of the rotation direction "Rd" and the real speed "Nf" as shown in FIG. 4, and the motor is controlled to differ the rotation direction in respective cases. When the borrowing signal "Bo" is not issued, the motor needs to rotate in the positive direction, but it is controlled to rotate in two different directions depending on two different ways of calculating the speed deviation "$\epsilon$". The speed deviation "$\epsilon$" which is so calculated is multiplied by a magnification factor "K" and transferred to the driver 13 as a current command value "Im" together with the command of the rotation direction, and the driver 13 drives the motor 15. On the other hand, the monostable multivibrator 10 and the AND gate 11 enables the speed control circuit 12 during a predetermined time period after shifting of the signal "Bs" to "H" level, and thereafter they stop power supply to the motor 15.

As mentioned above, the needle position control is practiced by starting the counting pulse "Pe" of the four-pulse circuit 17 after generation of the needle position signal "Nd", then gradually decreasing the set speed and setting the set speed to zero when the number of pulses set by the switches $S_0$ to $S_7$ has been counted. The rotation direction of the motor is then reversed when the counted pulse is above the predetermined value, and the motor is stopped when the predetermined number of pulses has been counted over.

Figure 5:
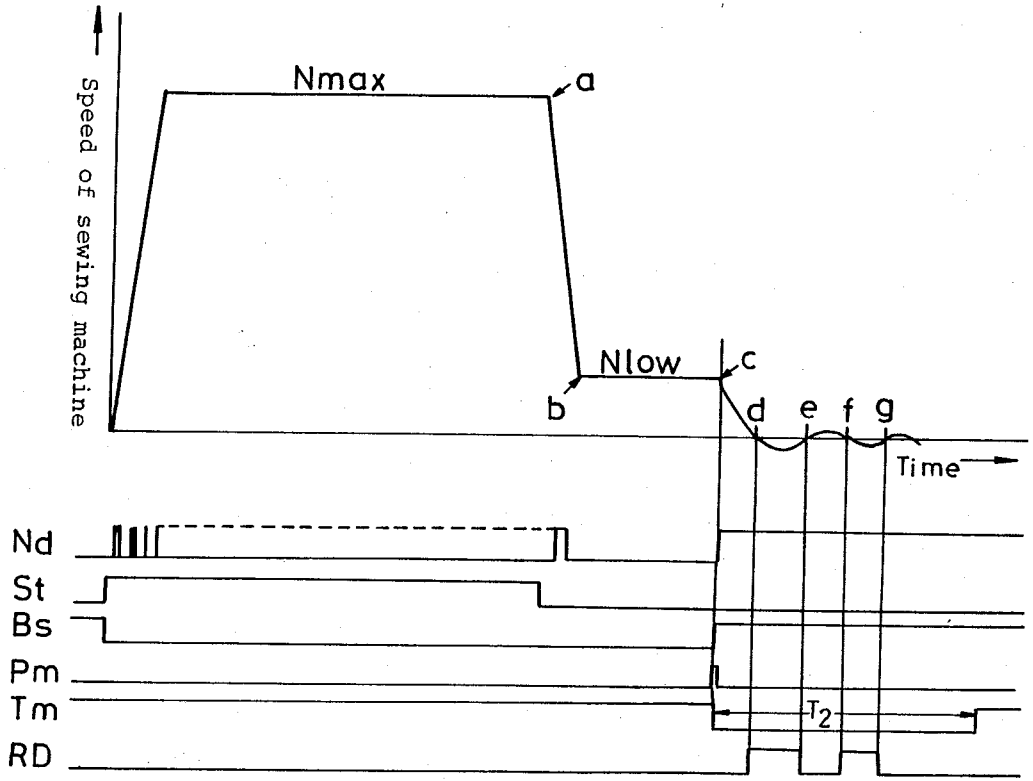
FIG. 5 is a timing chart showing an operation of the motor controller of a sewing machine in accordance with the present invention.

FIG. 5 is a timing chart showing the above-mentioned motion. The lower speed of the motor (namely equal to the needle speed) is set at point "a". After the speed of the sewing machine (needle) is quickly decreased, it reaches the lower speed "N low" at point "b". The front edge of the needle position signal is detected at point "C", and the pulse number corresponding to the aimed stop position set by the switches is preset into the counter. Thereafter, the set speed is gradually decreased by subtracting the fourfold multiplied pulse signal "Pe", and when the remaining pulse number reaches to zero, the set speed becomes zero and the motor stops. Hereupon, though a phenomenon of reversing of the rotation direction due to inertia of the control system or delay of current flow to coil of the motor are generally observed at the stopping (shown between the points d and e or f and g), such reversing phenomenon is detected by the rotation direction discriminating circuit 19. Therefore, the speed control is completely practiced by the above-mentioned method shown in FIG. 4 so that the vibration is damped and the motor (or the needle) finally stops.

As mentioned above, in the motor control apparatus of the present invention, the pulse signals generated by the rotation of the motor are counted after detection of the needle position signal, and feedback control is used to stop the motor at the position set by the plural switches in the needle positioning process. Accordingly, a motor controller for a sewing machine with very accurate positioning and control of the needle at stopping is obtainable.

We claim:

1. A motor controller for a sewing machine, comprising:

pulse generating means for generating plural pulse signals for each rotation of a motor shaft, speed measuring means for measuring rotational speed of said motor shaft and for generating a signal representative of a measured rotational speed of said motor shaft, needle position detecting means for detecting the position of a needle and for generating a needle position signal, motion command means for commanding the starting or stopping of rotation of said motor shaft, speed setting means for setting the rotational speed of said motor shaft and for generating a lower speed setting signal when a stop signal is generated by said motion command means, speed control means for controlling the rotational speed of said motor shaft, needle position confirming means for confirming the position of said needle and for generating a position control command signal when said signal representative of a measured rotational speed reaches a lower speed set by said lower speed setting signal, and said needle position signal is detected, counter means for counting the number of said pulse signals by receiving said position control command signal from said needle position confirming means and for generating a first speed setting signal which is reduced to zero when the counted number of pulse signals reaches a predetermined value, converter means for converting an output of said counter means into a second speed setting signal, and switching means for disabling said lower speed setting signal from said speed setting means and for enabling said second speed setting signal from said converter means in response to said position control command signal.

2. A motor controller for a sewing machine in accordance with claim 1, wherein said counter means contains setting means constituted by plural switches and starts to count down for each of said pulse signals after presetting a setting value from said speed setting means by generation of said position control command signal.

3. A motor controller for a sewing machine in accordance with claim 1, wherein said converter means contains multiplication means for multiplying the first speed setting signal from said counter means by a predetermined setting value so as to generate said second speed setting signal.

4. A motor controller for a sewing machine, comprising:

encoder means for generating at least two pulse signals whose phases are respectively shifted by 90 degrees for each rotation of a motor shaft, speed measuring means for generating a real speed signal which represents the real rotational speed of said motor shaft based on said pulse signals, needle position detecting means for detecting the position of a needle and for generating a needle position signal, motion command means for commanding the starting or stopping of rotation of said motor shaft, speed setting means for setting the rotational speed of said motor shaft and for generating a lower speed setting signal when a stop signal is generated by said motion command means, speed control means for controlling the rotational speed of said motor shaft so as to minimize the deviation between said real speed signal and a lower speed set by said lower speed setting signal of said speed setting means, needle position confirming means for confirming the position of said needle and for generating a position control command signal when said real speed signal reaches said lower speed and said needle position signal is detected, counter means for counting the number of said pulse signals by receiving said position control command signal from said needle position confirming means and for generating a first speed setting signal which is reduced to zero when the counted number of pulse signals reaches a predetermined value, converter means for converting an output of said counter means into a second speed setting signal, switching means for disabling said lower speed setting signal from said speed setting means for enabling said second speed setting signal from said converter means in response to said position control command signal, and rotation direction discriminating means for generating a rotational direction signal indicating a rotation direction of said motor shaft by detecting the order of phase delay between said at least two pulse signals, for controlling the rotational direction of said motor shaft, and for generating a switching signal which is inputted into said counter means so as to cause said counter means to count up or count down.

5. A motor controller for a sewing machine in accordance with claim 4, wherein said counter means contains setting means constituted by plural switches and up and down counter means which presets a setting value from said speed setting means by generation of said position control command signal.

6. A motor controller for a sewing machine in accordance with claim 4, wherein said converter means contains multiplying means for multiplying the first speed setting signal from said counter means by a predetermined setting value so as to generate said second speed setting signal.

* * * * *